US005255433A

United States Patent [19]

Jin et al.

[11] Patent Number: 5,255,433

[45] Date of Patent: Oct. 26, 1993

[54] ENGINE BLOCK CYLINDER LINERS MADE OF ALUMINUM ALLOY COMPOSITES

[75] Inventors: Iljoon Jin; Paul W. Jeffrey; David J. Lloyd, all of Kingston, Canada; Sergio Gallo, Turin, Italy

[73] Assignee: Alcan International Limited, Montreal, Canada

[21] Appl. No.: 863,399

[22] Filed: Apr. 3, 1992

Related U.S. Application Data

[63] Continuation of Ser. No. 683,311, Apr. 10, 1991, abandoned.

[51] Int. Cl.[5] ..... B22D 19/14

[52] U.S. Cl. ..... 29/888.061; 164/97

[58] Field of Search ..... 29/888.06; 164/97, 76.1, 164/900; 123/193 C, 193 R; 92/169.1, 169.4

[56] References Cited

U.S. PATENT DOCUMENTS

| | | | |
|---|---|---|---|
| 1,720,722 | 7/1929 | Dean | 29/DIG. 47 |
| 1,955,243 | 4/1934 | Liebergeld et al. | 29/DIG. 47 |
| 2,673,131 | 3/1954 | Kistler | 29/888.061 |
| 3,648,351 | 3/1972 | Kibler | 29/DIG. 47 |
| 3,878,880 | 4/1975 | Jones | 29/888.061 |
| 3,903,951 | 9/1975 | Kaneko et al. | 29/888.061 |
| 4,473,103 | 9/1984 | Kenney et al. | 164/97 |
| 4,494,461 | 1/1985 | Pryor et al. | 164/900 |
| 4,537,167 | 8/1985 | Eudier et al. | 123/193 C |
| 4,604,779 | 8/1986 | Narita et al. | 123/193 |
| 4,694,881 | 9/1987 | Busk | 164/900 |
| 4,873,952 | 10/1989 | Narita et al. | 29/888.061 |
| 4,998,578 | 3/1991 | Dwivedi et al. | 164/97 |

FOREIGN PATENT DOCUMENTS

| | | | |
|---|---|---|---|
| 0367229 | 5/1990 | European Pat. Off. . | |
| 2344358 | 10/1977 | France . | |
| 0165512 | 12/1981 | Japan | 29/DIG. 47 |
| 8706624 | 8/1987 | PCT Int'l Appl. . | |

OTHER PUBLICATIONS

International Search Report (PCT/CA92/00147).

*Primary Examiner*—Irene Cuda

*Attorney, Agent, or Firm*—Cooper & Dunham

[57] ABSTRACT

Engine block cylinder liners are formed from high melting temperature aluminum alloy composites. A cast composite is first formed from a high melting temperature aluminum alloy, e.g. Al-Mn, Al-Cr, Al-Ni, Al-Fe or Al-Cr-Zr, and refractory particles, e.g. alumina. This composite is then extruded into a tubular sleeve. If desired, a long tube may be extruded which is then cut into desired lengths. These new cylinder liners have the following desirable properties: high melting temperature, good strength at the service temperature, higher thermal conductivity than cast iron, good wear resistance and good corrosion resistance.

5 Claims, 1 Drawing Sheet

ENGINE BLOCK CYLINDER LINERS MADE OF ALUMINUM ALLOY COMPOSITES

This a continuation of application Ser. No. 07/683,311 filed Apr. 10, 1991, abn.

BACKGROUND OF THE INVENTION

This invention relates to engine block cylinder liners made from high melting temperature aluminum alloy composites.

The most widely used material for cylinder liners of lightweight aluminum alloy engine blocks is cast iron. The reasons that cast iron is used for the liners are: (1) low cost; (2) high wear resistance; (3) high elevated temperature strength; and (4) high melting temperature. However, cast iron has a high specific gravity and a low thermal conductivity. Aluminum alloys which have a high wear resistance, e.g. hypereutectic aluminum-silicon alloys can also be used as cylinder liner material. However, when such material is used, there is a high risk of melting the liner during casting of the engine block, if the engine block is cast around the liner.

It is the object of the present invention to provide a new liner based on an aluminum alloy which is capable of overcoming both the wear and casting problems.

SUMMARY OF THE INVENTION

According to the present invention, it has been found that the above problems can be overcome by using as the material for the cylinder liners an aluminum alloy composite comprising an aluminum alloy having a high melting temperature reinforced with non-metallic refractory particles. A cast composite of the above materials is first prepared and this composite is then extruded to form a tubular sleeve. Preferably, a long tubular sleeve is extruded which is then cut to the desired length to form a cylinder liner.

A variety of aluminum alloys are available having higher melting temperatures than the engine block's alloys. Examples of these include Al-Mn, Al-Cr, Al-Ni, Al-Fe and Al- Cr-Zr alloys. When these alloys are reinforced with ceramic particles, they attain the properties required for cylinder liners in high performance engines, i.e.: high melting temperature, good strength at the service temperature, higher thermal conductivity than cast iron, good wear resistance and good corrosion resistance. The ceramic particles may be selected from metal oxides, metal nitrides, metal carbides and metal silicides. Preferably, however, alumina is used.

BRIEF DESCRIPTION OF THE DRAWINGS

Further features and advantages of the invention will become apparent upon reading the following detailed description of the preferred embodiment with reference to the attached drawings in which.

DETAILED DESCRIPTION OF THE PREFERRED EMBODIMENTS

The cylinder liners of the present invention are lighter and have a higher heat conductivity than the conventional cast iron liners and thus provide a significant reduction in cylinder operating temperatures as well as weight.

The invention provides a method for preparing a tubular sleeve liner which comprises preparing a cast composite material of non-metallic particles and an aluminum alloy having a high melting temperature, and extruding the composite material into a tubular sleeve. The long tubular sleeve is extruded, and then cut into desired lengths for cylinder liners.

The high melting aluminum alloy is selected from Al-Mn, Al-Cr, Al-Ni, Al-Fe and Al-Cr-Zr alloys, while the non-metallic particles are refractory particles selected from metal oxides, metal nitrides, metal carbides and metal silicides. Preferably, the refractory particles are particles of alumina.

The invention further provides a tubular sleeve or engine cylinder block liner made in accordance with the method of the present invention.

In the procedure for making the cylinder liners of this invention, the cast aluminum alloy composite is first formed by a procedure such as that described in Skibo et al. PCT International Publication No. W087/06624 published November 5, 1987 or as described in Lloyd et al., U.S. application Ser. No. 07/538,225, the entire contents of each of which are incorporated by reference herein. The composite thus obtained is then cast by conventional direct chill casting to form an extrusion ingot. This ingot can then be extruded into a long tube, which is cut to the desired length.

A preferred embodiment of the invention is illustrated by the following example.

EXAMPLE 1

An aluminum alloy containing 1% by weight of manganese and 0.15% by weight of magnesium admixed therewith 10% by volume of alumina powder using a system of the type shown in U.S. application Ser. No. 07/538,225. The molten composite was cast into a 6 ¾'diameter ingot by conventional direct chill casting. The ingot was extruded into tubes of two different sizes: (1) 78.3 mm ID/87.8 mm OD and (2) 85.7 mm ID/95.2 mm OD.

Figure 1A:
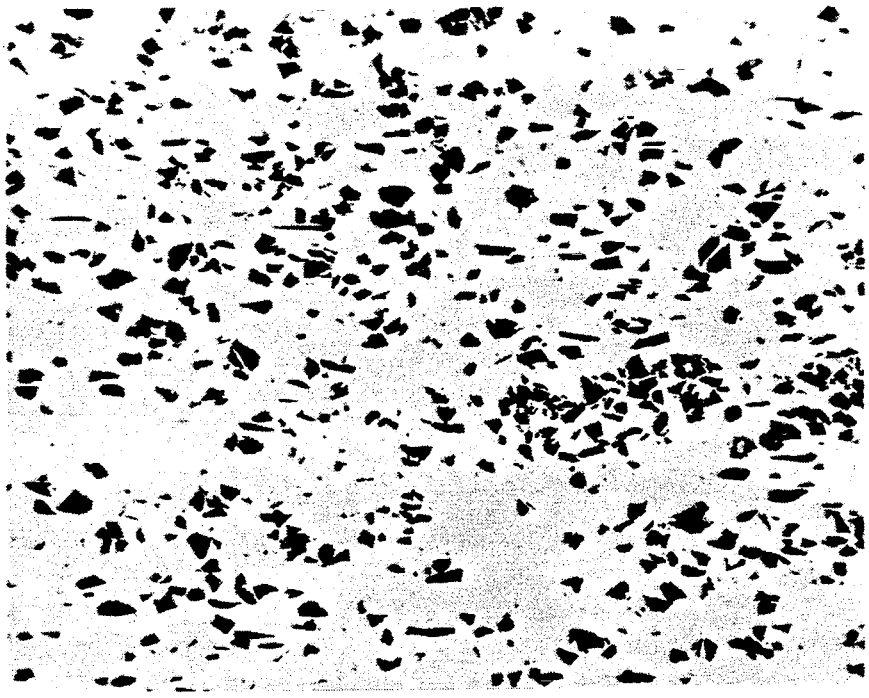
FIG. 1A is a photomicrograph of a longitudinal cross-section of a cylinder liner produced in accordance with the method of the present invention taken at 200x, and showing the microstructure of the cylinder liner.
Figure 1B:
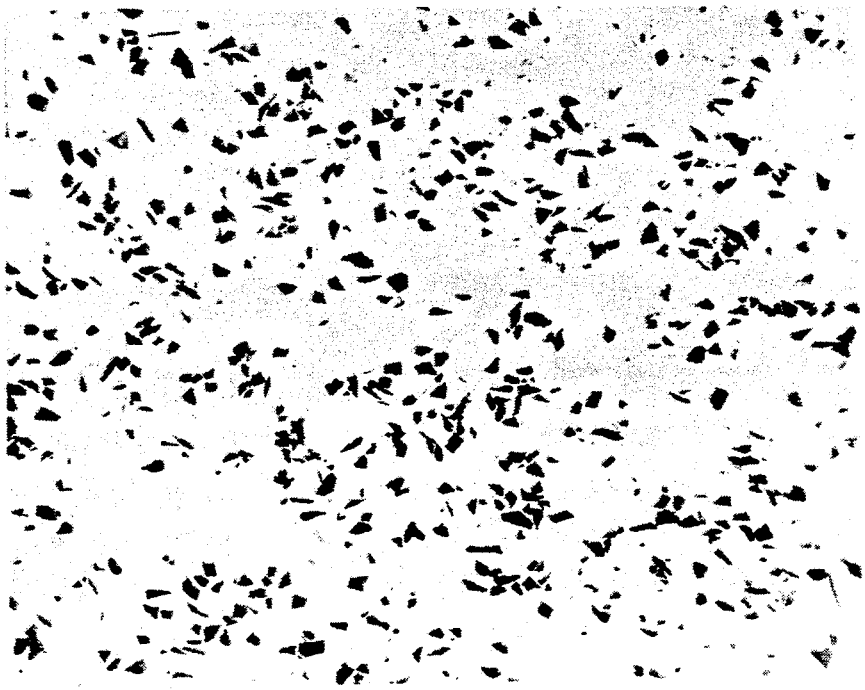
FIG. 1B is a photomicrograph of a transverse cross-section of a cylinder liner produced in accordance with the method of the present invention taken at 200x, and showing the microstructure of the cylinder liner.

Referring to FIGS. 1A and 1B, the microstructure of the liner so produced shows a fairly uniform distribution of alumina particles in the matrix and a good bonding between the particles and the matrix without any undesirable interface reaction product.

We claim:

1. A method for preparing an engine block cylinder liner which comprises:

preparing a cast composite material of non-metallic ceramic particles and an aluminum alloy having a high melting temperature, and extruding the composite material into a tubular sleeve for use as an engine block cylinder.

2. A method according to claim 1 wherein the high melting aluminum alloy is selected from Al-Mn, Al-Cr, Al-Ni, Al-Fe and Al-Cr-Zr alloys.

3. A method according to claim 2 wherein the non-metallic particles are refractory particles selected from metal oxides, metal nitrides, metal carbides and metal silicides.

4. A method according to claim 3 wherein the refractory particles are particles of alumina.

5. A method according to claim 3 wherein a long tubular sleeve is extruded, and then cut into desired lengths for cylinder liners.

* * * * *